US010029391B2

(12) United States Patent
Hall et al.

(10) Patent No.: US 10,029,391 B2
(45) **Date of Patent: *Jul. 24, 2018**

(54) HIGH IMPACT RESISTANT TOOL WITH AN APEX WIDTH BETWEEN A FIRST AND SECOND TRANSITIONS

(71) Applicant: Schlumberger Technology Corporation, Houston, TX (US)

(72) Inventors: David R. Hall, Provo, UT (US); Ronald B. Crockett, Payson, UT (US); Casey Webb, Provo, UT (US); Michael Beazer, Provo, UT (US)

(73) Assignee: SCHLUMBERGER TECHNOLOGY CORPORATION, Houston, TX (US)

( * ) Notice: Subject to any disclaimer, the term of this patent is extended or adjusted under 35 U.S.C. 154(b) by 416 days.

This patent is subject to a terminal disclaimer.

(21) Appl. No.: 14/592,235

(22) Filed: Jan. 8, 2015

(65) Prior Publication Data

US 2015/0122553 A1 May 7, 2015

Related U.S. Application Data

(63) Continuation of application No. 12/828,287, filed on Jun. 30, 2010, now Pat. No. 8,960,337, which is a (Continued)

(51) Int. Cl.
*E21B 10/567* (2006.01)
*B28D 1/18* (2006.01)
(Continued)

(52) U.S. Cl.
CPC ..... *B28D 1/186* (2013.01); *B02C 4/305* (2013.01); *E21B 10/5673* (2013.01);
(Continued)

(58) Field of Classification Search
CPC ..... E21B 10/5673; E21B 10/5676; E21B 10/5735; E21C 35/183; B28D 1/186; B02C 4/305; Y10T 408/81; Y10T 407/26
See application file for complete search history.

(56) References Cited

U.S. PATENT DOCUMENTS 4,315 A 12/1845 Hemming
37,223 A 12/1862 Fosdick
(Continued)

FOREIGN PATENT DOCUMENTS

DE 3500261 A1 7/1986
DE 3818213 A1 11/1989
(Continued)

OTHER PUBLICATIONS

Office Action issued in counterpart U.S. Appl. No. 13/342,523; Dated Jul. 25, 2014 (9 pages).
(Continued)

*Primary Examiner* — Brad Harcourt

(57) ABSTRACT

In one aspect of the present invention, a high impact resistant tool comprises a sintered polycrystalline diamond body bonded to a cemented metal carbide substrate at an interface, the body comprising a substantially pointed geometry with an apex, the apex comprising a curved surface that joins a leading side and a trailing side of the body at a first and second transitions respectively, an apex width between the first and second transitions is less than a third of a width of the substrate, and the body also comprises a body thickness from the apex to the interface greater than a third of the width of the substrate.

9 Claims, 15 Drawing Sheets

Related U.S. Application Data continuation-in-part of application No. 11/673,634, filed on Feb. 12, 2007, now Pat. No. 8,109,349, which is a continuation-in-part of application No. 11/668,254, filed on Jan. 29, 2007, now Pat. No. 7,353,893, which is a continuation-in-part of application No. 11/553,338, filed on Oct. 26, 2006, now Pat. No. 7,665,552.

(51) Int. Cl.
*E21B 10/573* (2006.01)
*B02C 4/30* (2006.01)
*E21C 35/183* (2006.01)

(52) U.S. Cl.
CPC ..... *E21B 10/5676* (2013.01); *E21B 10/5735* (2013.01); *E21C 35/183* (2013.01); *Y10T 407/26* (2015.01); *Y10T 408/81* (2015.01)

(56) References Cited

U.S. PATENT DOCUMENTS 465,103 A 12/1891 Wegner
616,118 A 12/1898 Kunhe
946,060 A 1/1910 Looker
1,116,154 A 11/1914 Stowers
1,183,630 A 5/1916 Bryson
1,189,560 A 7/1916 Gondos
1,360,908 A 11/1920 Everson
1,387,733 A 8/1921 Midgett
1,460,671 A 7/1923 Hebsacker
1,544,757 A 7/1925 Hufford et al.
1,821,474 A 9/1931 Mercer
1,879,177 A 9/1932 Gault
2,004,315 A 6/1935 Fean
2,054,255 A 9/1936 Howard
2,064,255 A 12/1936 Garfield
2,121,202 A 6/1938 Kilgore
2,124,436 A 7/1938 Stansel et al.
2,124,438 A 7/1938 Struk et al.
2,169,223 A 8/1939 Christian
2,218,130 A 10/1940 Court
2,320,136 A 5/1943 Kammerer
2,466,991 A 4/1949 Kammerer
2,540,464 A 2/1951 Stokes
2,544,036 A 3/1951 Kammerer
2,545,036 A 3/1951 Kammerer
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,254,392 A 6/1966 Novkov
3,294,186 A 12/1966 Buell
3,301,339 A 1/1967 Pennebaker, Jr.
3,342,531 A 9/1967 Krekeler
3,342,532 A 9/1967 Krekeler
3,379,264 A 4/1968 Cox
3,397,012 A 8/1968 Krekeler
3,429,390 A 2/1969 Bennett
3,493,165 A 2/1970 Schonfeld
3,512,838 A 5/1970 Kniff
3,583,504 A 6/1971 Aalund
3,626,775 A 12/1971 Gentry
3,650,565 A 3/1972 Kniff
3,655,244 A 4/1972 Swisher
3,745,396 A 7/1973 Quintal et al.
3,745,623 A 7/1973 Wentorf, Jr. et al.
3,746,396 A 7/1973 Radd
3,764,493 A 10/1973 Rosar
3,765,493 A 10/1973 Rosar et al.
3,800,891 A 4/1974 White et al.
3,807,804 A 4/1974 Kniff
3,820,848 A 6/1974 Kniff
3,821,993 A 7/1974 Kniff
3,830,321 A 8/1974 McKenry et al.
3,932,952 A 1/1976 Helton et al.
3,942,838 A 3/1976 Bailey et al.
3,945,681 A 3/1976 White
3,955,635 A 5/1976 Skidmore
3,957,307 A 5/1976 Varda
3,960,223 A 6/1976 Kleine
4,005,914 A 2/1977 Newman
4,006,936 A 2/1977 Crabiel
4,081,042 A 3/1978 Johnson et al.
4,096,917 A 6/1978 Harris
4,098,362 A 7/1978 Bonnice
4,106,577 A 8/1978 Summers
4,109,737 A 8/1978 Bovenkerk
RE29,900 E 2/1979 Kniff
4,140,004 A 2/1979 Smith et al.
4,156,329 A 5/1979 Daniels et al.
4,176,723 A 12/1979 Arceneaux
4,199,035 A 4/1980 Thompson
4,201,421 A 5/1980 Den Besten et al.
4,211,508 A 7/1980 Dill et al.
4,224,380 A 9/1980 Bovenkerk et al.
4,247,150 A 1/1981 Wrulich et al.
4,251,109 A 2/1981 Roepke
4,253,533 A 3/1981 Baker, III
4,268,089 A 5/1981 Spence et al.
4,277,106 A 7/1981 Sahley
4,280,573 A 7/1981 Sudnishnikov et al.
4,289,211 A 9/1981 Lumen
4,304,312 A 12/1981 Larsson
4,307,786 A 12/1981 Evans
D264,217 S 5/1982 Prause et al.
4,333,902 A 6/1982 Hara
4,333,986 A 6/1982 Tsuji et al.
4,334,586 A 6/1982 Schumacher
4,337,980 A 7/1982 Krekeler
4,390,992 A 6/1983 Judd
4,397,361 A 8/1983 Langford, Jr.
4,397,362 A 8/1983 Dice et al.
4,412,980 A 11/1983 Tsuji et al.
4,416,339 A 11/1983 Baker et al.
4,425,315 A 1/1984 Tsuji et al.
4,439,250 A 3/1984 Acharya et al.
4,445,580 A 5/1984 Sahley
4,448,269 A 5/1984 Ishikawa et al.
4,465,221 A 8/1984 Schmidt
4,481,016 A 11/1984 Campbell et al.
4,484,644 A 11/1984 Cook et al.
4,484,783 A 11/1984 Emmerich
4,489,986 A 12/1984 Dziak
4,497,520 A 2/1985 Ojanen
4,499,795 A 2/1985 Radtke
4,525,178 A 6/1985 Hall
4,531,592 A 7/1985 Hayatdavoudi
4,535,853 A 8/1985 Ippolito et al.
4,537,448 A 8/1985 Ketterer
4,538,691 A 9/1985 Dennis
4,542,942 A 9/1985 Zitz et al.
4,566,545 A 1/1986 Story et al.
4,573,744 A 3/1986 Clemmow et al.
4,574,895 A 3/1986 Dolezal et al.
4,583,786 A 4/1986 Thorpe et al.
4,599,731 A 7/1986 Ware et al.
4,604,106 A 8/1986 Hall
4,627,503 A 12/1986 Horton
4,627,665 A 12/1986 Ewing et al.
4,636,253 A 1/1987 Nakai et al.
4,636,353 A 1/1987 Seon et al.
4,640,374 A 2/1987 Dennis
4,647,111 A 3/1987 Bronder et al.
4,647,546 A 3/1987 Hall, Jr. et al.
4,650,776 A 3/1987 Cerceau et al.
4,655,508 A 4/1987 Tomlinson
4,657,308 A 4/1987 Clapham
4,660,890 A 4/1987 Mills
4,662,348 A 5/1987 Hall et al.

(56) References Cited

U.S. PATENT DOCUMENTS 4,664,705 A 5/1987 Horton et al.
4,678,237 A 7/1987 Collin
4,682,987 A 7/1987 Brady et al.
4,684,176 A 8/1987 Den Besten et al.
4,688,856 A 8/1987 Elfgen
4,690,691 A 9/1987 Komanduri
4,694,918 A 9/1987 Hall
4,702,525 A 10/1987 Sollami et al.
4,725,098 A 2/1988 Beach
4,726,718 A 2/1988 Meskin et al.
4,728,153 A 3/1988 Ojanen et al.
4,729,440 A 3/1988 Hall
4,729,441 A 3/1988 Peetz et al.
4,729,603 A 3/1988 Elfgen
4,736,533 A 4/1988 May et al.
4,746,379 A 5/1988 Rabinkin
4,765,419 A 8/1988 Scholz et al.
4,765,686 A 8/1988 Adams
4,765,687 A 8/1988 Parrott
4,776,662 A 10/1988 Valleix
4,776,862 A 10/1988 Wiand
4,798,026 A 1/1989 Cerceau
4,804,231 A 2/1989 Buljan et al.
4,811,801 A 3/1989 Salesky et al.
4,815,342 A 3/1989 Brett et al.
4,815,345 A 3/1989 Radice
4,836,614 A 6/1989 Ojanen
4,850,649 A 7/1989 Beach et al.
4,852,672 A 8/1989 Behrens
4,880,154 A 11/1989 Tank
4,889,017 A 12/1989 Fuller et al.
4,893,875 A 1/1990 Lonn et al.
D305,871 S 2/1990 Geiger
4,921,310 A 5/1990 Hedlund et al.
D308,683 S 6/1990 Meyers
4,932,723 A 6/1990 Mills
4,940,099 A 7/1990 Deane et al.
4,940,288 A 7/1990 Stiffler et al.
4,944,559 A 7/1990 Sionnet et al.
4,944,772 A 7/1990 Cho
4,951,762 A 8/1990 Lundell
4,956,238 A 9/1990 Griffin
4,962,822 A 10/1990 Pascale
4,981,184 A 1/1991 Knowlton et al.
5,007,685 A 4/1991 Beach et al.
5,009,273 A 4/1991 Grabinski
5,011,515 A 4/1991 Frushour
5,027,914 A 7/1991 Wilson
5,038,873 A 8/1991 Jurgens
D324,056 S 2/1992 Frazee
D324,226 S 2/1992 Frazee
5,088,797 A 2/1992 O'Neill
5,092,310 A 3/1992 Walen et al.
5,106,166 A 4/1992 O'Neill
5,112,165 A 5/1992 Hedlund et al.
5,119,714 A 6/1992 Scott et al.
5,119,892 A 6/1992 Clegg et al.
5,141,063 A 8/1992 Quesenbury
5,141,289 A 8/1992 Stiffler
D329,809 S 9/1992 Bloomfield
5,154,245 A 10/1992 Waldenstrom et al.
5,172,777 A 12/1992 Siracki et al.
5,186,268 A 2/1993 Clegg
5,186,892 A 2/1993 Pope
5,222,566 A 6/1993 Taylor et al.
5,235,961 A 8/1993 McShannon
5,248,006 A 9/1993 Scott et al.
5,251,964 A 10/1993 Ojanen
5,255,749 A 10/1993 Bumpurs et al.
5,261,499 A 11/1993 Grubb
5,265,682 A 11/1993 Russell et al.
D342,268 S 12/1993 Meyer
5,303,984 A 4/1994 Ojanen
5,304,342 A 4/1994 Hall, Jr. et al.
5,319,855 A 6/1994 Beevers et al.
5,332,051 A 7/1994 Knowlton
5,332,348 A 7/1994 Lemelson
5,348,108 A 9/1994 Scott et al.
5,351,770 A 10/1994 Cawthorne et al.
5,361,859 A 11/1994 Tibbitts
5,364,319 A 11/1994 Boll et al.
D357,485 S 4/1995 Mattsson et al.
5,410,303 A 4/1995 Comeau et al.
5,415,462 A 5/1995 Massa
5,417,292 A 5/1995 Polakoff
5,417,475 A 5/1995 Graham et al.
5,423,389 A 6/1995 Warren et al.
5,447,208 A 9/1995 Lund et al.
5,494,477 A 2/1996 Flood et al.
5,503,463 A 4/1996 Ojanen
5,507,357 A 4/1996 Hult et al.
D371,374 S 7/1996 Fischer et al.
5,533,582 A 7/1996 Tibbitts
5,535,839 A 7/1996 Brady
5,542,993 A 8/1996 Rabinkin
5,544,713 A 8/1996 Dennis
5,560,440 A 10/1996 Tibbitts
5,568,838 A 10/1996 Struthers et al.
5,653,300 A 8/1997 Lund et al.
5,655,614 A 8/1997 Azar
5,662,720 A 9/1997 O'Tighearnaigh
5,678,644 A 10/1997 Fielder
5,709,279 A 1/1998 Dennis
5,720,528 A 2/1998 Ritchey
5,725,283 A 3/1998 O'Neill
5,730,502 A 3/1998 Montgomery, Jr.
5,732,784 A 3/1998 Nelson
5,738,415 A 4/1998 Parrott
5,738,698 A 4/1998 Kapoor et al.
5,794,728 A 8/1998 Palmberg
5,811,944 A 9/1998 Sampayan et al.
5,823,632 A 10/1998 Burkett
5,837,071 A 11/1998 Andersson et al.
5,845,547 A 12/1998 Sollami
5,848,657 A 12/1998 Flood et al.
5,871,060 A 2/1999 Jensen et al.
5,875,862 A 3/1999 Jurewicz et al.
5,884,979 A 3/1999 Latham
5,890,552 A 4/1999 Scott et al.
5,896,938 A 4/1999 Moeny et al.
5,914,055 A 6/1999 Roberts et al.
5,934,542 A 8/1999 Nakamura et al.
5,935,718 A 8/1999 Demo et al.
5,944,129 A 8/1999 Jensen
5,947,215 A 9/1999 Lundell
5,950,743 A 9/1999 Cox
5,957,223 A 9/1999 Doster et al.
5,957,225 A 9/1999 Sinor
5,967,247 A 10/1999 Pessier
5,967,250 A 10/1999 Lund et al.
5,979,571 A 11/1999 Scott et al.
5,992,405 A 11/1999 Sollami
5,992,547 A 11/1999 Caraway et al.
5,992,548 A 11/1999 Silva et al.
6,000,483 A 12/1999 Jurewicz et al.
6,003,623 A 12/1999 Miess
6,006,846 A 12/1999 Tibbitts et al.
6,018,729 A 1/2000 Zacharia et al.
6,019,434 A 2/2000 Emmerich
6,021,859 A 2/2000 Tibbitts et al.
6,039,131 A 3/2000 Beaton
6,041,875 A 3/2000 Rai et al.
6,044,920 A 4/2000 Massa et al.
6,050,354 A 4/2000 Pessier et al.
6,051,079 A 4/2000 Andersson et al.
6,056,911 A 5/2000 Griffin
6,059,054 A 5/2000 Portwood et al.
6,065,552 A 5/2000 Scott et al.
6,068,072 A 5/2000 Besson et al.
6,068,913 A 5/2000 Cho et al.
6,095,262 A 8/2000 Chen
6,098,730 A 8/2000 Scott et al.
6,102,486 A 8/2000 Briese
6,109,377 A 8/2000 Massa et al.

(56) References Cited

U.S. PATENT DOCUMENTS 6,113,195 A 9/2000 Mercier et al.
6,131,675 A 10/2000 Anderson
6,150,822 A 11/2000 Hong et al.
6,170,917 B1 1/2001 Heinrich et al.
6,186,251 B1 2/2001 Butcher
6,193,770 B1 2/2001 Sung
6,196,340 B1 3/2001 Jensen et al.
6,196,636 B1 3/2001 Mills et al.
6,196,910 B1 3/2001 Johnson et al.
6,199,645 B1 3/2001 Anderson et al.
6,199,956 B1 3/2001 Kammerer
6,202,761 B1 3/2001 Forney
6,213,226 B1 4/2001 Eppink et al.
6,216,805 B1 4/2001 Lays et al.
6,220,375 B1 4/2001 Butcher et al.
6,220,376 B1 4/2001 Lundell
6,223,824 B1 5/2001 Moyes
6,223,974 B1 5/2001 Unde
6,257,673 B1 7/2001 Markham et al.
6,258,139 B1 7/2001 Jensen
6,260,639 B1 7/2001 Yong et al.
6,269,893 B1 8/2001 Beaton et al.
6,270,165 B1 8/2001 Peay
6,272,748 B1 8/2001 Smyth
6,290,007 B2 9/2001 Beuershausen et al.
6,290,008 B1 9/2001 Portwood et al.
6,296,069 B1 10/2001 Lamine et al.
6,302,224 B1 10/2001 Sherwood, Jr.
6,302,225 B1 10/2001 Yoshida et al.
6,315,065 B1 11/2001 Yong et al.
6,332,503 B1 12/2001 Pessier et al.
6,340,064 B2 1/2002 Fielder et al.
6,341,823 B1 1/2002 Sollami
6,354,771 B1 3/2002 Bauschulte et al.
6,357,832 B1 3/2002 Sollami
6,364,034 B1 4/2002 Schoeffler
6,364,420 B1 4/2002 Sollami
6,371,567 B1 4/2002 Sollami
6,375,272 B1 4/2002 Ojanen
6,375,706 B2 4/2002 Kembaiyan et al.
6,394,200 B1 5/2002 Watson et al.
6,408,052 B1 6/2002 McGeoch
6,408,959 B2 6/2002 Bertagnolli et al.
6,412,560 B1 7/2002 Bernat
6,419,278 B1 7/2002 Cunningham
6,424,919 B1 7/2002 Moran et al.
6,429,398 B1 8/2002 Legoupil et al.
6,435,287 B2 8/2002 Estes
6,439,326 B1 8/2002 Huang et al.
6,460,637 B1 10/2002 Siracki et al.
6,468,368 B1 10/2002 Merrick et al.
6,474,425 B1 11/2002 Truax et al.
6,478,383 B1 11/2002 Ojanen et al.
6,481,803 B2 11/2002 Ritchey
6,484,825 B2 11/2002 Watson et al.
6,484,826 B1 11/2002 Anderson et al.
6,499,547 B2 12/2002 Scott et al.
6,508,318 B1 1/2003 Linden et al.
6,508,516 B1 1/2003 Kammerer
6,510,906 B1 1/2003 Richert et al.
6,513,606 B1 2/2003 Krueger
6,516,293 B1 2/2003 Huang et al.
6,517,902 B2 2/2003 Drake et al.
6,533,050 B2 3/2003 Molloy
6,561,293 B2 5/2003 Minikus et al.
6,562,462 B2 5/2003 Griffin et al.
RE38,151 E 6/2003 Penkunas et al.
D477,225 S 7/2003 Pinnavaia
6,585,326 B2 7/2003 Sollami
6,585,327 B2 7/2003 Sollami
6,592,985 B2 7/2003 Griffin et al.
6,594,881 B2 7/2003 Tibbitts
6,596,225 B1 7/2003 Pope et al.
6,601,454 B1 8/2003 Botnan
6,601,662 B2 8/2003 Matthias et al.
6,622,803 B2 9/2003 Harvey et al.
6,644,755 B1 11/2003 Kammerer
6,659,206 B2 12/2003 Liang et al.
6,668,949 B1 12/2003 Rives
6,672,406 B2 1/2004 Beuershausen
6,685,273 B1 2/2004 Sollami
6,692,083 B2 2/2004 Latham
6,702,393 B2 3/2004 Mercier
6,709,065 B2 3/2004 Peay et al.
6,711,060 B2 3/2004 Sakakibara
6,719,074 B2 4/2004 Tsuda et al.
6,729,420 B2 5/2004 Mensa-Wilmot
6,732,817 B2 5/2004 Dewey et al.
6,732,914 B2 5/2004 Cadden et al.
6,733,087 B2 5/2004 Hall et al.
6,739,327 B2 5/2004 Sollami
6,749,033 B2 6/2004 Griffin et al.
6,758,530 B2 7/2004 Sollami
D494,031 S 8/2004 Moore, Jr.
D494,064 S 8/2004 Hook
6,786,557 B2 9/2004 Montgomery, Jr.
6,802,676 B2 10/2004 Noggle
6,822,579 B2 11/2004 Goswami et al.
6,824,225 B2 11/2004 Stiffler
6,846,045 B2 1/2005 Sollami
6,851,758 B2 2/2005 Beach
6,854,810 B2 2/2005 Montgomery, Jr.
6,861,137 B2 3/2005 Griffin et al.
6,863,352 B2 3/2005 Sollami
6,878,447 B2 4/2005 Griffin et al.
6,879,947 B1 4/2005 Glass
6,880,744 B2 4/2005 Noro et al.
6,889,890 B2 5/2005 Yamazaki et al.
6,918,636 B2 7/2005 Dawood
6,929,076 B2 8/2005 Fanuel et al.
6,933,049 B2 8/2005 Wan et al.
6,938,961 B2 9/2005 Broom
6,953,096 B2 10/2005 Gledhill et al.
6,959,765 B2 11/2005 Bell
6,962,395 B2 11/2005 Mouthaan
6,966,611 B1 11/2005 Sollami
6,994,404 B1 2/2006 Sollami
7,048,081 B2 5/2006 Smith et al.
7,094,473 B2 8/2006 Takayama et al.
7,097,258 B2 8/2006 Sollami
7,104,344 B2 9/2006 Kriesels et al.
7,152,703 B2 12/2006 Meiners et al.
7,204,560 B2 4/2007 Mercier et al.
7,207,398 B2 4/2007 Runia et al.
7,234,782 B2 6/2007 Stehney
D547,652 S 7/2007 Kerman et al.
D560,699 S 1/2008 Omi
7,350,601 B2 4/2008 Belnap et al.
7,377,341 B2 5/2008 Middlemiss et al.
7,380,888 B2 6/2008 Ojanen
7,384,105 B2 6/2008 Hall et al.
7,387,345 B2 6/2008 Hall et al.
7,396,086 B1 7/2008 Hall et al.
7,469,972 B2 12/2008 Hall et al.
7,543,662 B2 6/2009 Belnap et al.
7,575,425 B2 8/2009 Hall et al.
7,592,077 B2 9/2009 Gates, Jr. et al.
7,647,992 B2 1/2010 Fang et al.
7,665,552 B2 2/2010 Hall et al.
7,669,938 B2 3/2010 Hall et al.
7,693,695 B2 4/2010 Huang et al.
7,703,559 B2 4/2010 Shen et al.
7,730,977 B2 6/2010 Achilles
7,757,785 B2 7/2010 Zhang et al.
7,798,258 B2 9/2010 Singh et al.
8,109,349 B2 2/2012 Hall et al.
8,960,337 B2 * 2/2015 Hall ..... E21B 10/5673 175/425
2001/0004946 A1 6/2001 Jensen
2001/0040053 A1 11/2001 Beuershausen
2002/0070602 A1 6/2002 Sollami
2002/0074851 A1 6/2002 Montgomery
2002/0153175 A1 10/2002 Ojanen
2002/0175555 A1 11/2002 Mercier

(56) References Cited

U.S. PATENT DOCUMENTS

| | | | |
|---|---|---|---|
| 2003/0044800 | A1 | 3/2003 | Connelly et al. |
| 2003/0079565 | A1 | 5/2003 | Liang et al. |
| 2003/0137185 | A1 | 7/2003 | Sollami |
| 2003/0140360 | A1 | 7/2003 | Mansuy et al. |
| 2003/0141350 | A1 | 7/2003 | Noro et al. |
| 2003/0141753 | A1 | 7/2003 | Peay et al. |
| 2003/0209366 | A1 | 11/2003 | McAlvain |
| 2003/0213621 | A1 | 11/2003 | Britten et al. |
| 2003/0217869 | A1 | 11/2003 | Snyder et al. |
| 2003/0230926 | A1 | 12/2003 | Mondy et al. |
| 2003/0234280 | A1 | 12/2003 | Cadden et al. |
| 2004/0026132 | A1 | 2/2004 | Hall et al. |
| 2004/0026983 | A1 | 2/2004 | McAlvain |
| 2004/0065484 | A1 | 4/2004 | McAlvain |
| 2004/0155096 | A1 | 8/2004 | Zimmerman et al. |
| 2004/0173384 | A1 | 9/2004 | Yong et al. |
| 2004/0238221 | A1 | 12/2004 | Runia et al. |
| 2004/0256155 | A1 | 12/2004 | Kriesels et al. |
| 2004/0256442 | A1 | 12/2004 | Gates et al. |
| 2005/0035649 | A1 | 2/2005 | Mercier et al. |
| 2005/0044800 | A1 | 3/2005 | Hall et al. |
| 2005/0044987 | A1 | 3/2005 | Takayama et al. |
| 2005/0080595 | A1 | 4/2005 | Huang |
| 2005/0103530 | A1 | 5/2005 | Wheeler et al. |
| 2005/0159840 | A1 | 7/2005 | Lin et al. |
| 2005/0173966 | A1 | 8/2005 | Mouthaan |
| 2005/0263327 | A1 | 12/2005 | Meiners et al. |
| 2005/0269139 | A1* | 12/2005 | Shen ..... E21B 10/5735 175/430 |
| 2006/0032677 | A1 | 2/2006 | Azar et al. |
| 2006/0060391 | A1 | 3/2006 | Eyre et al. |
| 2006/0086537 | A1 | 4/2006 | Dennis |
| 2006/0086540 | A1 | 4/2006 | Griffin et al. |
| 2006/0125306 | A1 | 6/2006 | Sollami |
| 2006/0162969 | A1 | 7/2006 | Belnap et al. |
| 2006/0180354 | A1 | 8/2006 | Belnap et al. |
| 2006/0180356 | A1 | 8/2006 | Durairajan et al. |
| 2006/0186724 | A1 | 8/2006 | Stehney |
| 2006/0237236 | A1 | 10/2006 | Sreshta et al. |
| 2007/0013224 | A1 | 1/2007 | Stehney |
| 2007/0106487 | A1 | 5/2007 | Gavia et al. |
| 2007/0193782 | A1 | 8/2007 | Fang et al. |
| 2007/0221408 | A1 | 9/2007 | Hall et al. |
| 2007/0278017 | A1 | 12/2007 | Shen et al. |
| 2008/0006448 | A1 | 1/2008 | Zhang et al. |
| 2008/0011522 | A1 | 1/2008 | Hall et al. |
| 2008/0053710 | A1 | 3/2008 | Moss |
| 2008/0073126 | A1 | 3/2008 | Shen et al. |
| 2008/0073127 | A1 | 3/2008 | Zhan et al. |
| 2008/0142276 | A1 | 6/2008 | Griffo et al. |
| 2008/0156544 | A1 | 7/2008 | Singh et al. |
| 2008/0206576 | A1 | 8/2008 | Qian et al. |
| 2009/0166091 | A1 | 7/2009 | Matthews et al. |
| 2009/0223721 | A1 | 9/2009 | Dourfaye |

FOREIGN PATENT DOCUMENTS

| | | | |
|---|---|---|---|
| DE | 4039217 | A1 | 6/1992 |
| DE | 19821147 | A1 | 11/1999 |
| DE | 10163717 | C1 | 5/2003 |
| EP | 0295151 | A2 | 12/1988 |
| EP | 0412287 | A2 | 2/1991 |
| GB | 2004315 | A | 3/1979 |
| GB | 2037223 | A | 7/1980 |
| JP | 3123193 | B2 | 1/2001 |
| JP | 5280273 | B2 | 9/2013 |

OTHER PUBLICATIONS

International search report for PCT/US2007/075670, dated Nov. 17, 2008.

* cited by examiner

HIGH IMPACT RESISTANT TOOL WITH AN APEX WIDTH BETWEEN A FIRST AND SECOND TRANSITIONS

CROSS REFERENCE TO RELATED APPLICATIONS

This application is a continuation of U.S. patent application Ser. No. 12/828,287, filed on Jun. 30, 2010, which is a continuation-in-part of U.S. patent application Ser. No. 11/673,634, now U.S. Pat. No. 8,109,349, which was filed on Feb. 12, 2007 and entitled Thick Pointed Superhard Material, which is a continuation-in-part of U.S. patent application Ser. No. 11/668,254, now U.S. Pat. No. 7,353,893, filed Jan. 29, 2007, which is a continuation-in-part of U.S. patent application Ser. No. 11/553,338, now U.S. Pat. No. 7,665,552, filed Oct. 26, 2006. U.S. patent application Ser. No. 12/828,287 and U.S. patent application Ser. No. 11/673,634 are herein incorporated by reference for all that they contain.

BACKGROUND OF THE INVENTION

The invention relates to a high impact resistant tool that may be used in machinery such as crushers, picks, grinding mills, roller cone bits, rotary fixed cutter bits, earth boring bits, percussion bits or impact bits, and drag bits. More particularly, the invention relates to inserts comprised of a carbide substrate with a non-planer interface and an abrasion resistant layer of super hard material affixed thereto using a high pressure high temperature press apparatus.

U.S. Pat. No. 5,544,713 by Dennis, which is herein incorporated by reference for all that it contains, discloses a cutting element which has a metal carbide stud having a conic tip formed with a reduced diameter hemispherical outer tip end portion of said metal carbide stud. The tip is shaped as a cone and is rounded at the tip portion. This rounded portion has a diameter which is 35-60% of the diameter of the insert.

U.S. Pat. No. 6,408,959 by Bertagnolli et al., which is herein incorporated by reference for all that it contains, discloses a cutting element, insert or compact which is provided for use with drills used in the drilling and boring of subterranean formations.

U.S. Pat. No. 6,484,826 by Anderson et al., which is herein incorporated by reference for all that it contains, discloses enhanced inserts formed having a cylindrical grip and a protrusion extending from the grip.

U.S. Pat. No. 5,848,657 by Flood et al, which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

U.S. Pat. No. 4,109,737 by Bovenkerk which is herein incorporated by reference for all that it contains, discloses a rotary bit for rock drilling comprising a plurality of cutting elements mounted by interence-fit in recesses in the crown of the drill bit. Each cutting element comprises an elongated pin with a thin layer of polycrystalline diamond bonded to the free end of the pin.

U.S. patent application Ser. No. 2001/0004946 by Jensen, although now abandoned, is herein incorporated by reference for all that it discloses. Jensen teaches that a cutting element or insert with improved wear characteristics while maximizing the manufacturability and cost effectiveness of the insert. This insert employs a superabrasive diamond layer of increased depth and by making use of a diamond layer surface that is generally convex.

BRIEF SUMMARY OF THE INVENTION

In one aspect of the present invention, a high impact resistant tool comprises a sintered polycrystalline diamond body bonded to a cemented metal carbide substrate at an interface. The body comprises a substantially pointed geometry with an apex, and the apex comprises a curved surface that joins a leading side and a trailing side of the body at a first and second transitions respectively. An apex width between the first and second transitions is less than a third of a width of the substrate, and the body also comprises a body thickness from the apex to the interface greater than a third of the width of the substrate.

The body thickness may be measured along a central axis of the tool. The tool central axis may intersect the apex and the interface. The apex width may be a quarter or less than the width of the substrate, and the body thickness may be less than ¾ the width of the substrate. The body thickness may be greater than a substrate thickness along the central axis. The diamond body may comprise a volume between 75 and 150 percent of a substrate volume. The curved surface may comprise a radius of curvature between 0.050 and 0.110 inches. The curved surface may comprise a plurality of curvatures, or a non-circular curvature.

The diamond volume contained by the curved surface may comprise less than five percent of catalyzing material by volume, and at least 95 percent of the void between polycrystalline diamond grains may comprise a catalyzing material. In some embodiments, at least 99 percent of the voids between polycrystalline diamond grains comprise a catalyzing material.

The diamond body may comprise a substantially conical shape, a substantially pyramidal shape, or a substantially chisel shape. The body may comprise a side which forms a 35 to 55 degree angle with the central axis of the tool. In some embodiments, the side may form an angle substantially 45 degrees. The body may comprise a substantially convex side or a substantially concave side.

The interface at the substrate may comprise a tapered surface starting from a cylindrical rim of the substrate and ending at an elevated flatted central region formed in the substrate.

In some embodiments, the tool may comprise the characteristic of withstanding impact greater than 200 Joules.

In some embodiments, the substrate may be attached to a drill bit, a percussion drill bit, a roller cone bit, a fixed bladed bit, a milling machine, an indenter, a mining pick, an asphalt pick, a cone crusher, a vertical impact mill, a hammer mill, a jaw crusher, an asphalt bit, a chisel, a trenching machine, or combinations thereof.

DETAILED DESCRIPTION OF THE INVENTION AND THE PREFERRED EMBODIMENT

Figure 1:
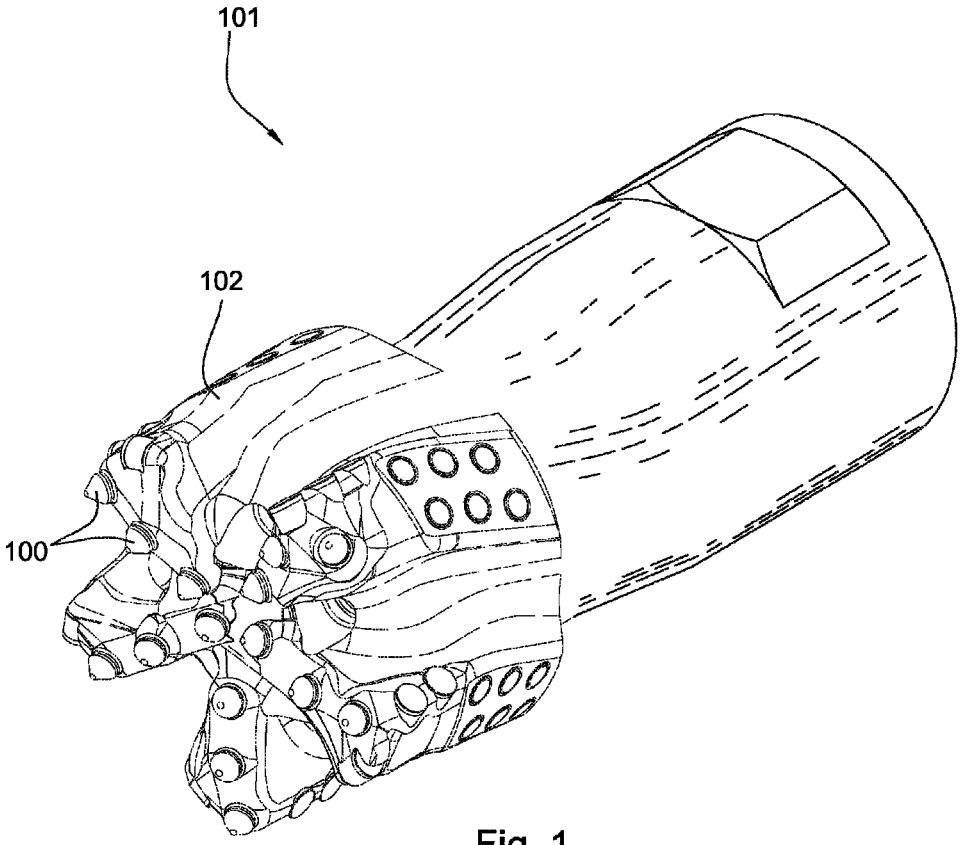
FIG. 1 is a perspective view of an embodiment of a drill bit.

Referring now to the figures, FIG. 1 discloses an embodiment of a fixed bladed drill bit 101. Drill bit 101 comprises a plurality of high impact tools 100. High impact tools 100 may be attached to a body 102 of the drill bit 101 by brazing, press fit, or other mechanical or material method.

Figure 2:
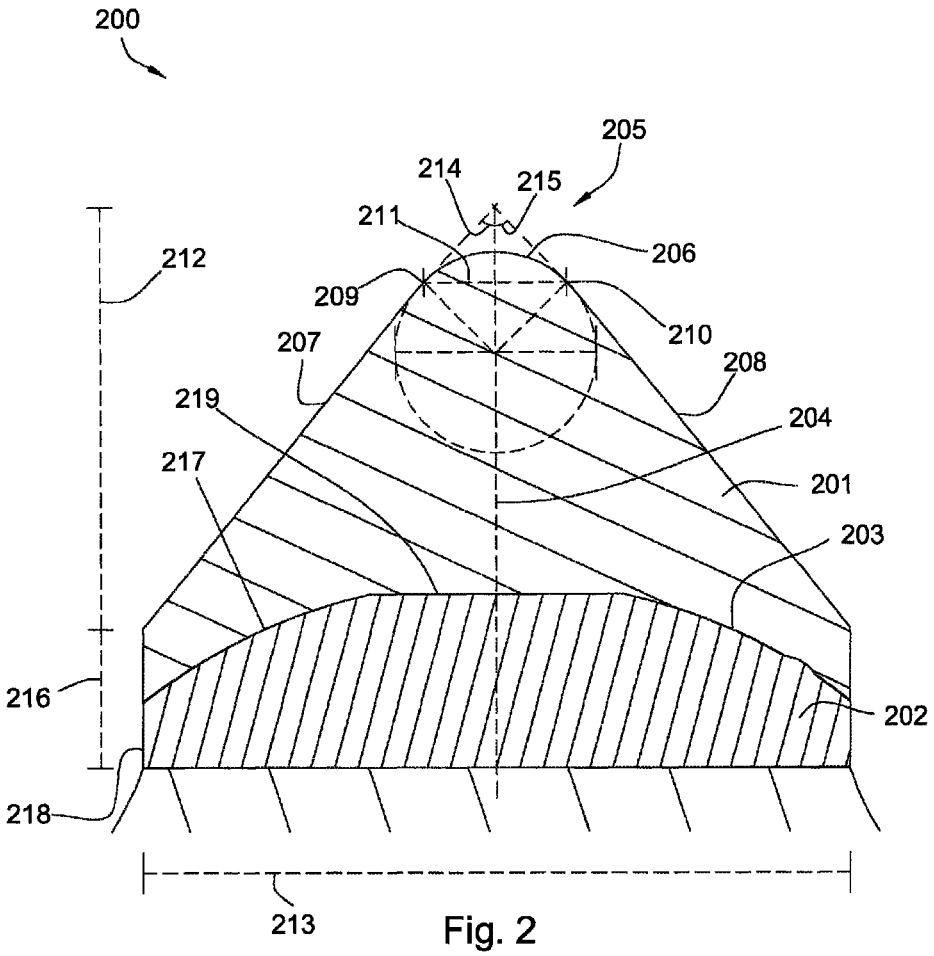
FIG. 2 is a cross-sectional view of an embodiment of a high impact tool.

FIG. 2 discloses an embodiment of a high impact tool 200, comprising a sintered polycrystalline diamond body 201 and a cemented metal carbide substrate 202 bonded at an interface 203. A central axis 204 may intersect the substrate 202 and an apex 205 of the diamond body 201. The polycrystalline diamond body 201 and the cemented metal carbide substrate 202 may be processed together in a high-pressure, high temperature press.

The sintered polycrystalline diamond body 201 may comprise substantially pointed geometry. The apex 205 comprises a curved surface 206 that joins a leading side 207 and a trailing side 208 at a first transition 209 and a second transition 210. The apex 205 comprises an apex width 211 between the first transition 209 and the second transition 210. The diamond body 201 comprises a thickness 212 from the apex 205 to the interface 203. The diamond body thickness 212 may be greater than one third of a width 213 of the substrate 202. The apex width 211 may be less than one third the width 213 of the substrate 202, and in some embodiments, the apex width may be less than one quarter of the substrate width.

The leading side 207 and the trailing side 208 of the diamond body 201 may form angles 214 and 215 with the central axis 204. Angles 214 and 215 may be between 35 and 55 degrees, and in some embodiments may be substantially 45 degrees. Angles 214 and 215 may be equal, or in some embodiments, may be substantially unequal. In some embodiments, the leading side and trailing side comprise linear geometry. In other embodiments, the leading and trailing sides may be concave, convex, or combinations thereof.

The curved surface 206 may comprise a radius of curvature between 0.050 inches and 0.110 inches. In some embodiments, the apex width 211 may be substantially less than twice the radius of curvature. The curved surface may comprise a variable radius of curvature, a curve defined by a parametric spline, a parabolic curve, an elliptical curve, a catenary curve, other conic shapes, linear portions, or combinations thereof.

In some embodiments, a volume contained by the curved surface 206 may comprise less than 5% of catalyzing material by volume, and at least 95% of the void between polycrystalline diamond grains may comprise catalyzing material. In some embodiments, at least 99% of the void between diamond grains comprises catalyzing material.

The body thickness 212 may be measured along the central axis 204 of the tool. The central axis 212 may intersect the apex 205 of the diamond body and the interface 203 between the diamond body and the cemented metal carbide substrate. The body thickness 212 may be greater than a substrate thickness 216 as measured along the central axis 204. The volume of the diamond body portion may be 75% to 150% of the volume of the cemented metal carbide substrate portion.

The interface 203 may comprise a tapered portion 217 starting at a cylindrical portion 218 and ending at an elevated central flatted region 219. It is believed that the increased bonding surface area resulting from this geometry provides higher total bond strength.

High impact tool 200 may be used in industrial applications such as drill bits, percussion drill bits, roller cone bits, fixed bladed bits, milling machines, indenters, mining picks, asphalt picks, cone crushers, vertical impact mills, hammer mills, jaw crushers, asphalt bits, chisels, trenching machines, or combinations thereof.

In some embodiments, the high impact tool 200 may comprise the characteristic of withstanding impact of greater than 200 Joules in a drop test.

Figure 3A:
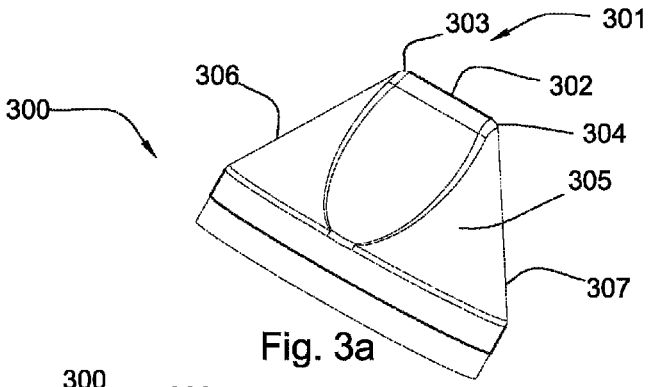
FIG. 3*a* is a perspective view of another embodiment of a high impact tool.
Figure 3B:
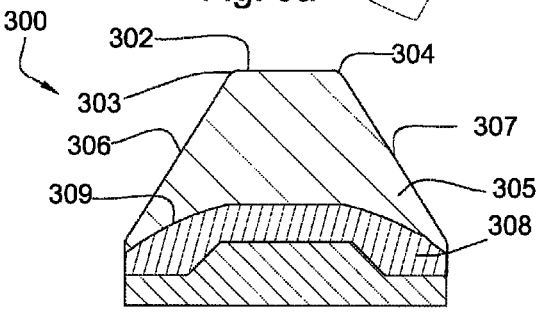
FIG. 3*b* is a cross-sectional view of another embodiment of high impact tool.
Figure 3C:
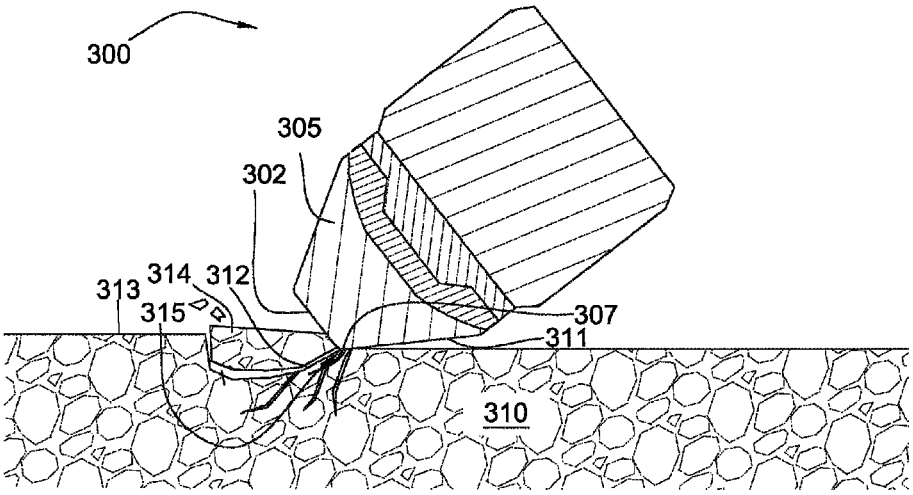
FIG. 3*c* is a cross-sectional view of another embodiment of a high impact tool.

FIG. 3*a* discloses another embodiment of a high impact tool 300. In this embodiment, an apex 301 comprises a linear portion 302 and two curved areas 303 and 304. A diamond body portion 305 comprises a leading side 306 and a trailing side 307. Curved areas 303 and 304 join the linear portion 302 to the leading side 306 and trailing side 307. FIG. 3*b* shows a cross sectional view of high impact tool 300. Curved areas 303 and 304 tangentially join linear portion 302 to leading side 306 and trailing side 307. A cemented metal carbide substrate 308 joins diamond body portion 305 at a non-planer interface 309. FIG. 3*c* shows the high impact tool 300 in use degrading a formation 310. An apex 311 of the high impact tool 300 impinges the formation 310, causing cracks 312 to propagate. Cracks 312 may propagate to a surface 313 of the formation 310, allowing chips 314 to break free. A contact area 315 between the apex 311 and the formation 310 comprises a surface area sufficiently small to create high levels of stress in the formation, thereby causing the formation to fail. Linear portion 302 and trailing side 307 support the high compressive loads in the diamond body 305 and allow the high impact tool 300 to apply high loads to the formation without failure.

Figure 4A:
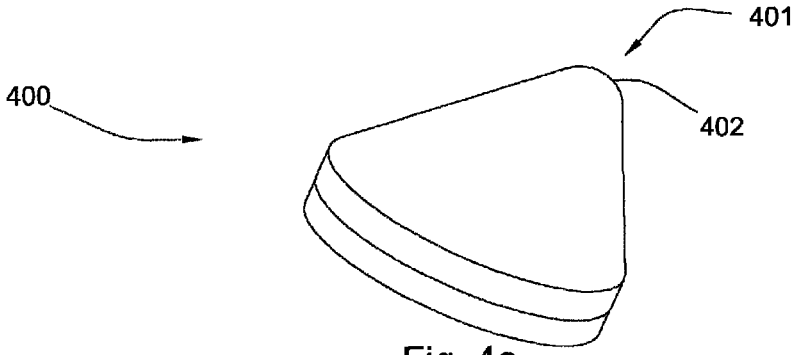
FIG. 4*a* is a perspective view of another embodiment of a high impact tool.
Figure 4B:
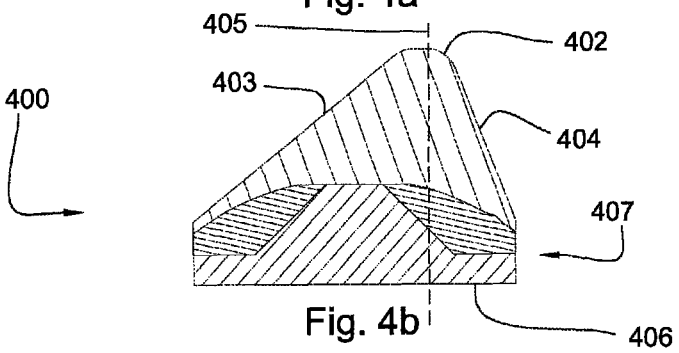
FIG. 4*b* is a cross-sectional view of another embodiment of high impact tool.
Figure 4C:
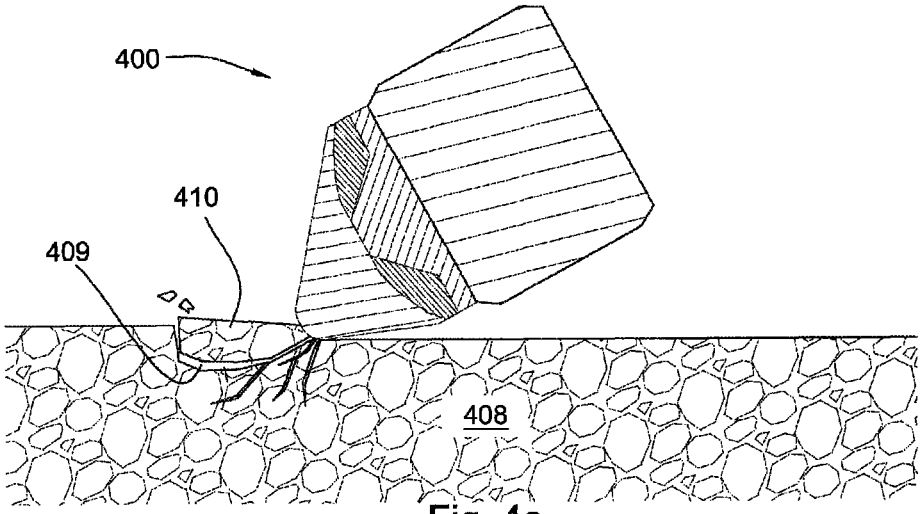
FIG. 4*c* is a cross-sectional view of another embodiment of a high impact tool.

FIG. 4*a* discloses another embodiment of a high impact tool 400. In this embodiment, a high impact tool 400 comprises an apex 401 with a curved surface 402. Curved surface 402 may comprise a radius of curvature from 0.050 to 0.110 inches, a variable radius, conic sections, or combinations thereof. FIG. 4*b* shows a cross section of the high impact tool 400. Curved surface 402 tangentially joins a leading side 403 and a trailing side 404. In this embodiment, leading side 403 and trailing side 404 form different angles with respect to an axis 405 normal to a surface 406 of a cemented metal carbide substrate 407 and passing through apex 401. FIG. 4*c* shows the high impact tool 400 impinging a formation 408, causing cracks 409 to propagate and chips 410 to break free from the formation.

Figure 5A:
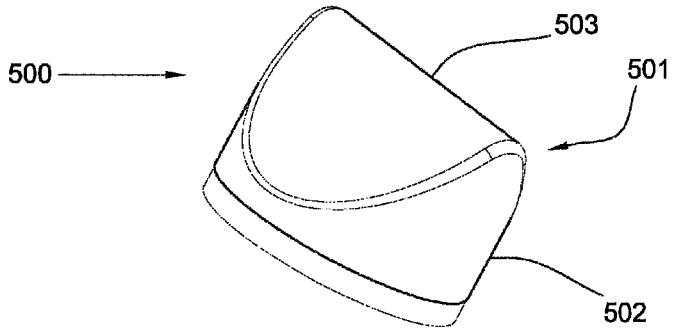
FIG. 5*a* is a perspective view of another embodiment of a high impact tool.
Figure 5B:
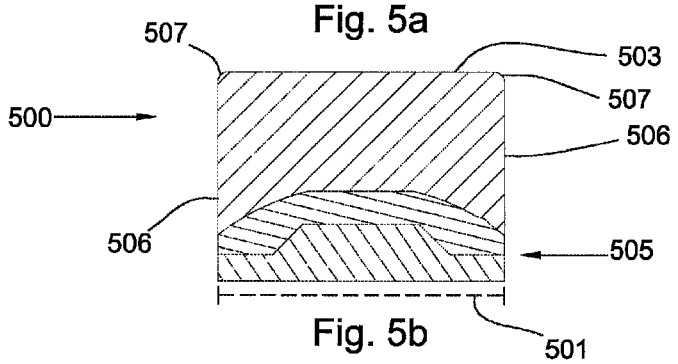
FIG. 5*b* is a cross-sectional view of another embodiment of high impact tool.
Figure 5C:
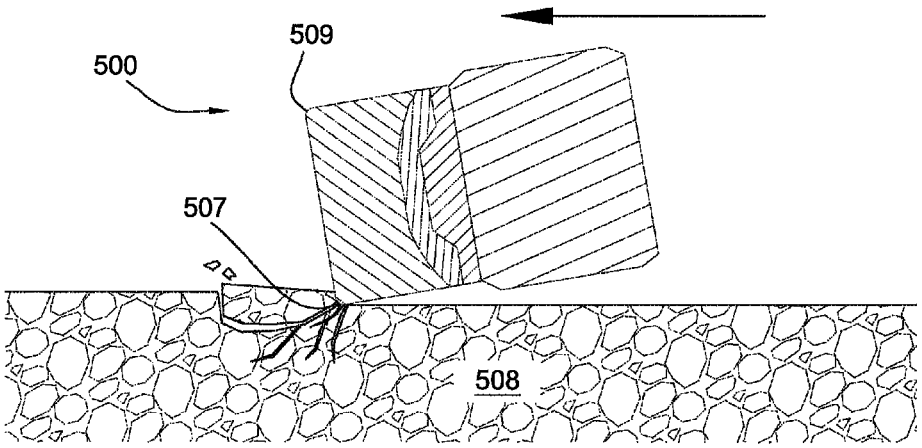
FIG. 5*c* is a cross-sectional view of another embodiment of a high impact tool.

FIG. 5*a* discloses another embodiment of a high impact tool 500 that comprises chisel-like geometry. An apex 501 is disposed intermediate a side wall 502 and a linear portion 503 of the tool 500. FIG. 5*b* discloses a cross sectional view of the tool 500. A linear portion 503 substantially equal to a diameter 501 of a cemented metal carbide substrate 505 joins to side walls 506 of the tool 500 at rounded apexes 507 in a tangential manner FIG. 5*c* shows the high impact tool 500 impinging a formation 508, causing cracks to propagate through the formation allowing chips to break free. After apex 507 becomes worn from abrasion and impact, tool 500 can be rotated 180 degrees to allow unworn apex 509 to impinge the formation, effectively doubling the life of the tool.

Figure 6A:
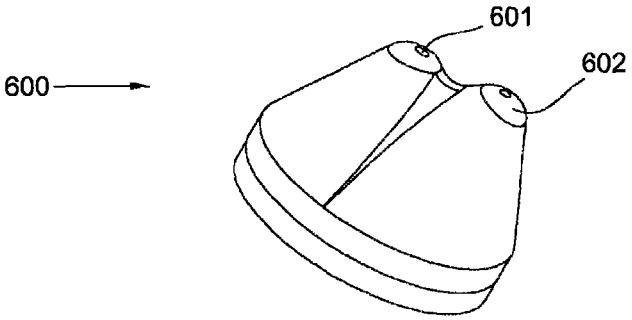
FIG. 6*a* is a perspective view of another embodiment of a high impact tool.
Figure 6B:
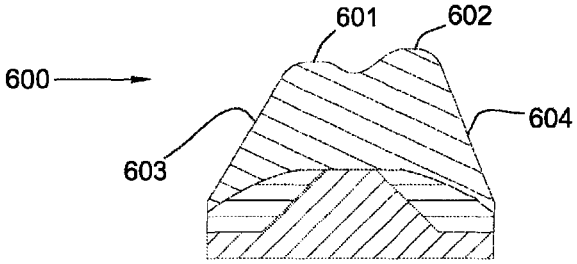
FIG. 6*b* is a cross-sectional view of another embodiment of high impact tool.
Figure 6C:
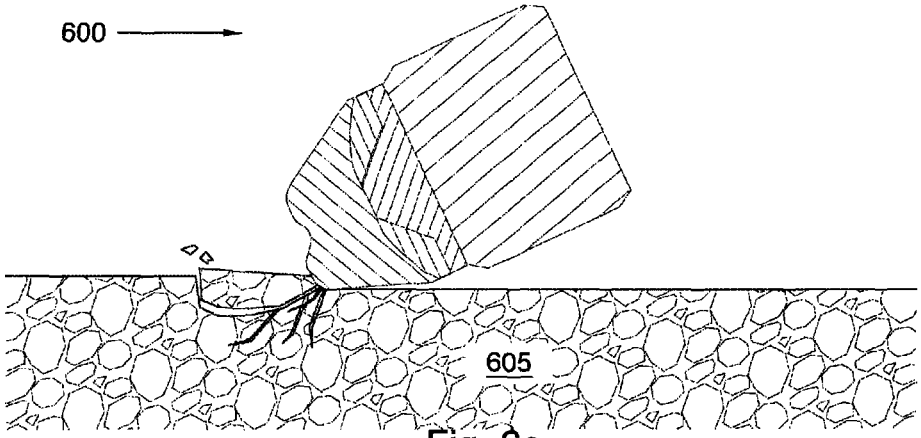
FIG. 6*c* is a cross-sectional view of another embodiment of a high impact tool.

FIG. 6*a* discloses a high impact tool 600 comprising conical geometry and two apexes 601 and 602. FIG. 6*b* shows a cross sectional view of the high impact tool 600. The conical geometry comprises a leading side 603 and a trailing side 604 tangentially joined to apexes 601 and 602. Apexes 601 and 602 may comprise equal or unequal radii of curvature. In FIG. 6*c*, the high impact tool 600 is shown impinging a formation 605.

Figure 7A:
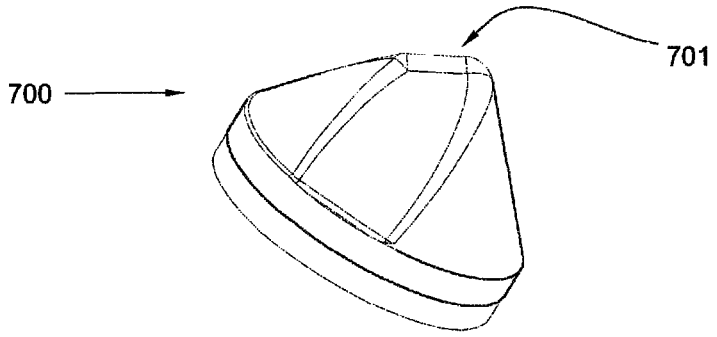
FIG. 7*a* is a perspective view of another embodiment of a high impact tool.
Figure 7B:
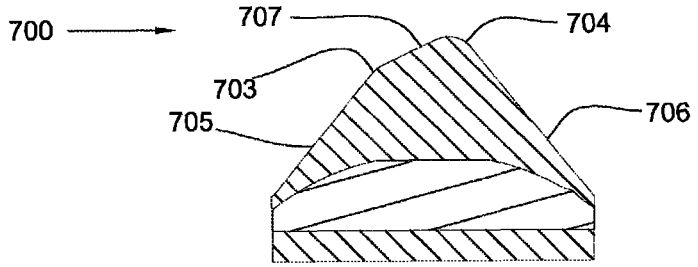
FIG. 7*b* is a cross-sectional view of another embodiment of high impact tool.
Figure 7C:
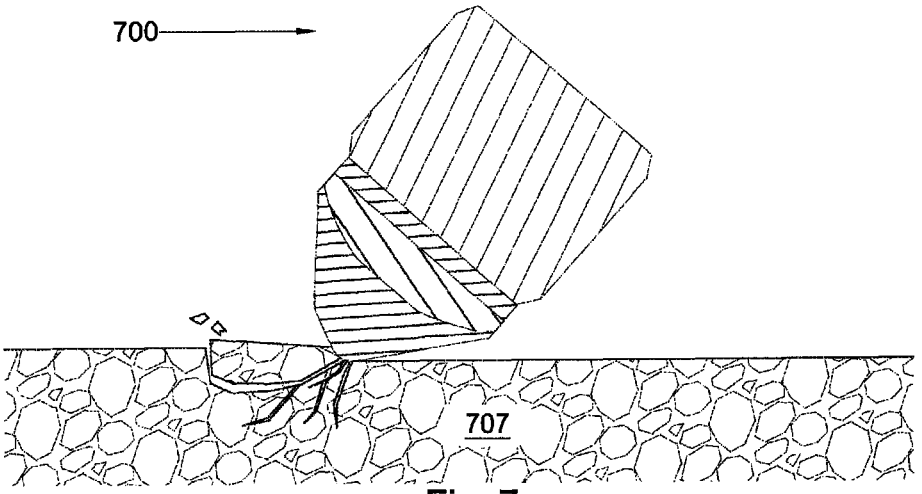
FIG. 7*c* is a cross-sectional view of another embodiment of a high impact tool.

FIG. 7*a* discloses a high impact tool 700 comprising an asymmetrical apex 701. FIG. 7*b* shows a cross-sectional view of the high impact tool 700. An angled linear portion 702 is disposed intermediate a first transition 703 and a second transition 704. First and second transitions tangentially join angled linear portion 702 to a leading side 705 and a trailing side 706. FIG. 7*c* shows high impact tool 700 impinging a formation 707.

Figure 8A:
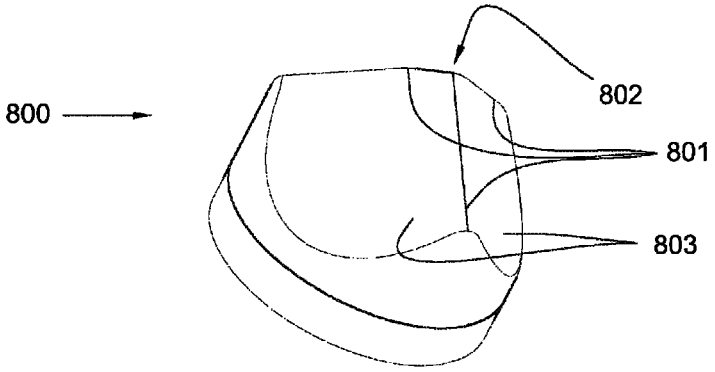
FIG. 8*a* is a perspective view of another embodiment of a high impact tool.
Figure 8B:
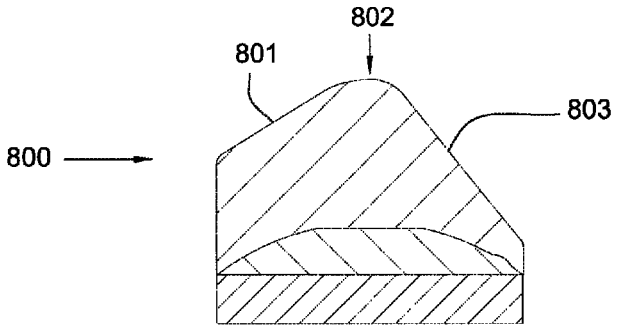
FIG. 8*b* is a cross-sectional view of another embodiment of high impact tool.
Figure 8C:
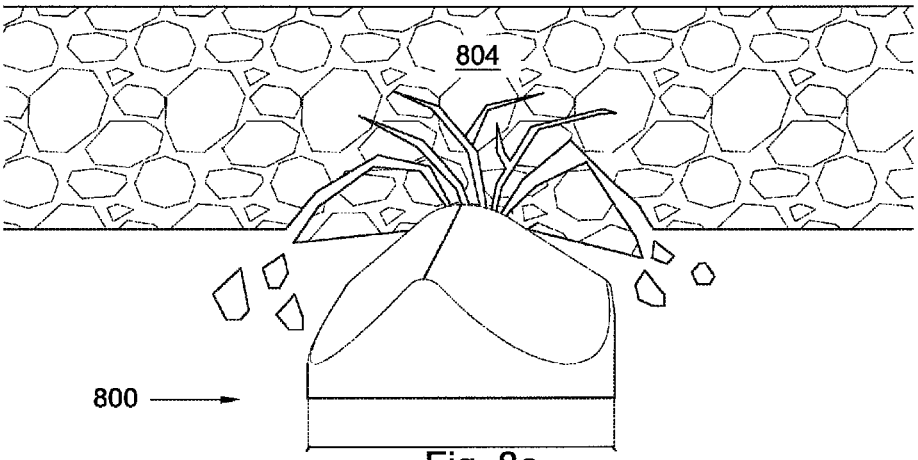
FIG. 8*c* is a cross-sectional view of another embodiment of a high impact tool.

FIG. 8*a* discloses a high impact tool 800 comprising pyramidal geometry with three edges 801 which converge at an apex 802. High impact tool 800 comprises planer faces 803 intermediate each edge 801. FIG. 8*b* shows a cross-sectional view of the high impact tool 800. The cross sectional plane passes through an edge 801, the apex 802, and a planer face 803. FIG. 8*c* discloses the high impact tool 800 impinging a formation 804. Pyramidal geometry may help to penetrate the formation and cause the formation to fail in tension, rather than in compression or shear.

Figure 9:
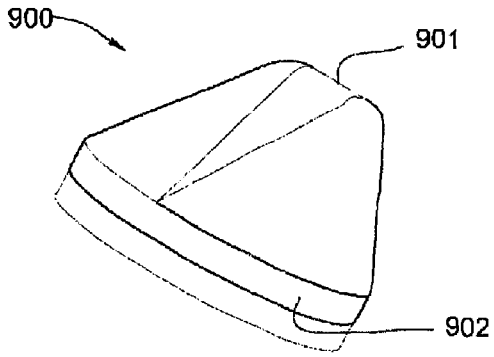
FIG. 9 is a perspective view of another embodiment of a high impact tool.

FIG. 9 discloses another embodiment of a high impact tool 900. In this embodiment, a linear portion 901 is offset from a center of a carbide substrate 902.

Figure 10:
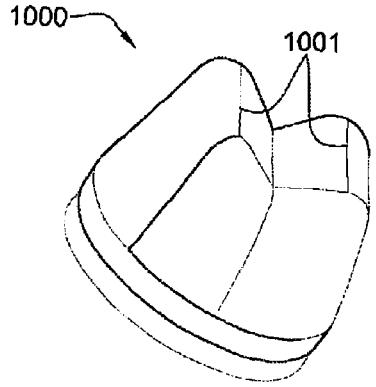
FIG. 10 is a perspective view of another embodiment of a high impact tool.

FIG. 10 discloses another embodiment of a high impact tool 1000 that comprises two linear portions 1001.

Figure 11:
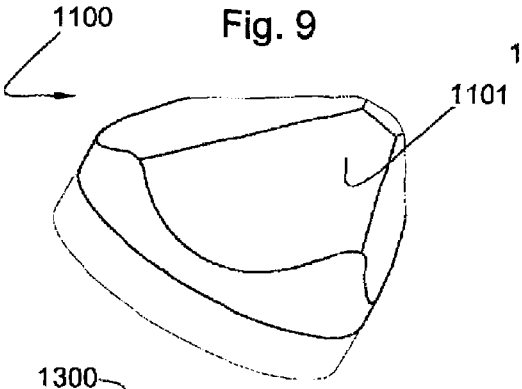
FIG. 11 is a perspective view of another embodiment of a high impact tool.

FIG. 11 discloses another embodiment of a high impact tool 1100 comprising asymmetrical polygonal geometry 1101.

Figure 12:
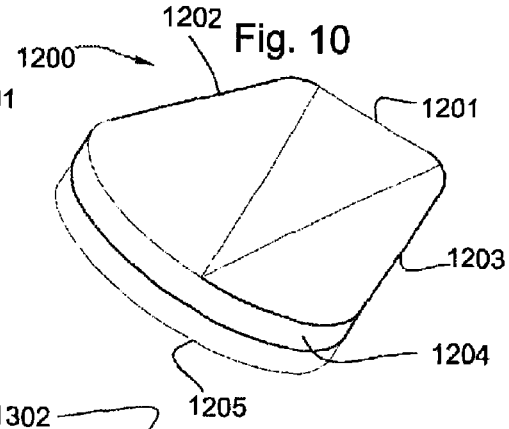
FIG. 12 is a perspective view of another embodiment of a high impact tool.

FIG. 12 discloses another embodiment of a high impact tool 1200. In this embodiment, high impact tool 1200 comprises a linear portion 1201 intermediate an angled side 1202 and a side 1203 vertical with respect to a surface 1205 of a cemented metal carbide substrate 1204.

Figure 13:
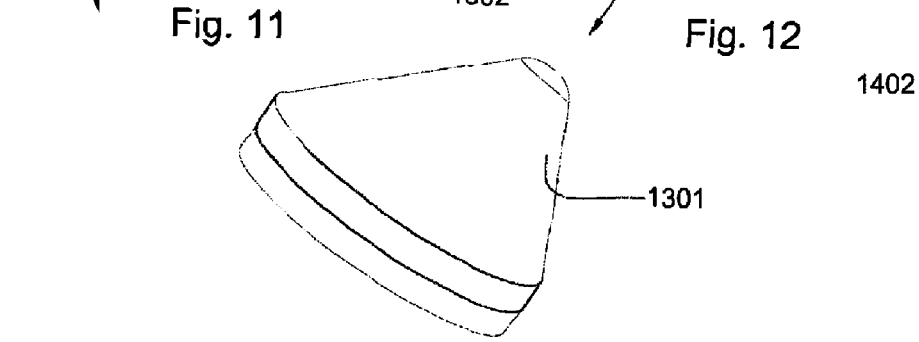
FIG. 13 is a perspective view of another embodiment of a high impact tool.

FIG. 13 discloses another embodiment of a high impact tool 1300. High impact tool 1300 comprises offset conical geometry 1301 and an apex 1302.

Figure 14:
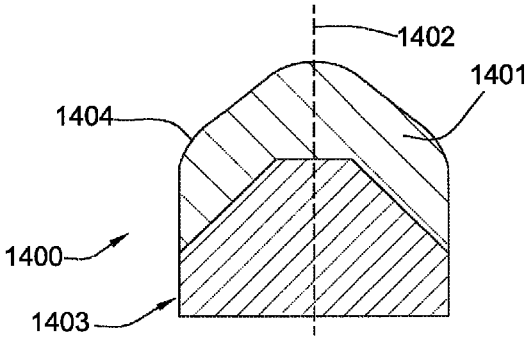
FIG. 14 is a cross-sectional view of another embodiment of a high impact tool.

FIG. 14 discloses a high impact tool 1400 with sintered polycrystalline diamond body 1401 that is thick along the central axis 1402 as well as adjacent the tool's periphery 1403. Further, the edge of the tool comprises a curvature 1404 with a 0.050 to 0.120 radius of curvature (measured in a plane that is common to the tool's central axis).

Figure 15:
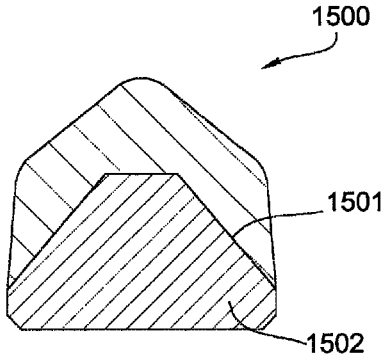
FIG. 15 is a cross-sectional view of another embodiment of a high impact tool.

FIG. 15 discloses a high impact tool 1500 with a steeper taper 1501 on its cemented carbide substrate 1502.

Figure 16:
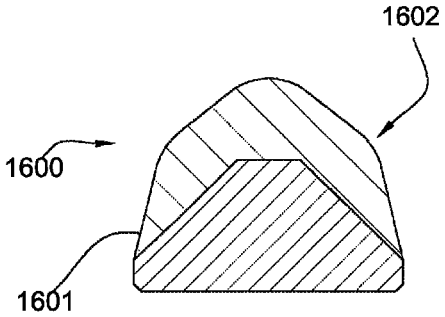
FIG. 16 is a cross-sectional view of another embodiment of a high impact tool.

FIG. 16 discloses a high impact tool 1600 with thick diamond at its periphery. Also the tool's side wall 1601 tapers to the tool's edge 1602.

Figure 17:
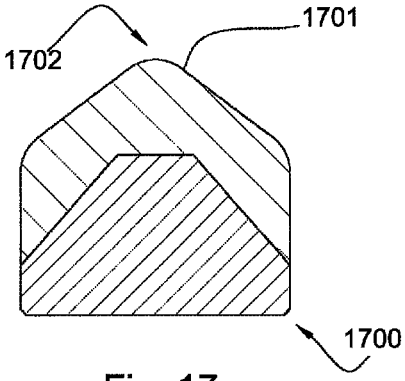
FIG. 17 is a cross-sectional view of another embodiment of a high impact tool.

FIG. 17 discloses a tool 1700 similar to the tool 1400 of FIG. 14, but with a sharper radius 1701 of curvature at the tool's apex 1702.

Figure 18:
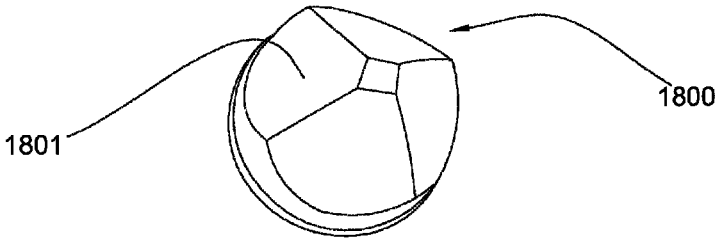
FIG. 18 is a perspective view of an embodiment of a high impact tool's substrate.

FIG. 18 discloses a carbide substrate 1800 without sintered polycrystalline diamond for illustrative purposes. In this embodiment, the substrate comprises flats 1801, although in the preferred embodiment, the substrate comprises no flats, but forms a continuous curvature.

Figure 19:
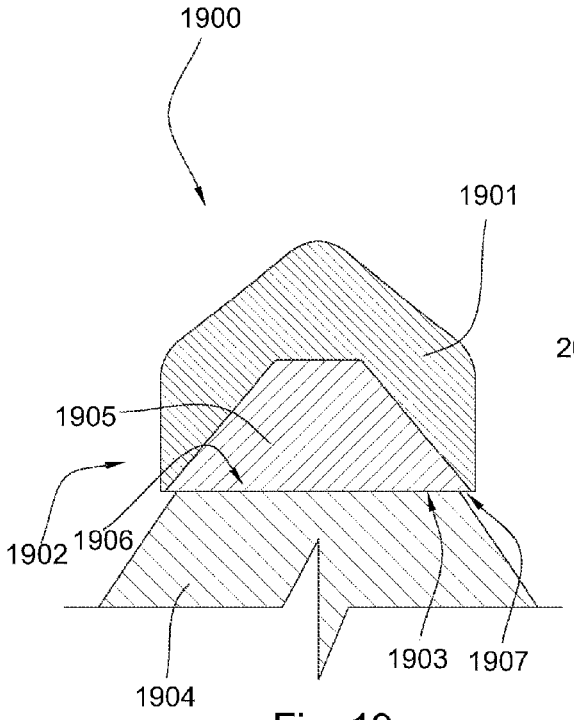
FIG. 19 is a cross-sectional view of another embodiment of a high impact tool.
Figure 20:
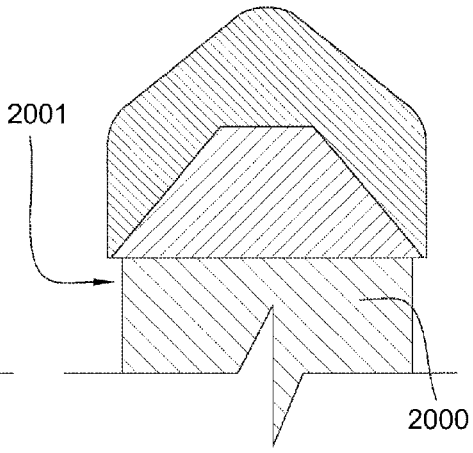
FIG. 20 is a cross-sectional view of another embodiment of a high impact tool.

FIG. 19 discloses a high impact tool 1900 that comprises a sintered polycrystalline diamond body 1901 along the entire periphery 1902 of the tool. The diamond body contacts the underside 1903 of the tool which is bonded to a support 1904. The support may be a tapered bolster on a road milling or mining pick. The cemented metal carbide substrate 1905 of the high impact tool may be brazed to the support. The underside of the high impact tool is slightly wider than the support's brazing surface 1906. It is believed that a slightly larger underside yields better results in most applications. While the cross sectional differences of FIG. 19 disclose a clearly visible overhang 1907, preferably the overhang is small enough that the braze material hides the overhang. In some embodiments, the overhang may only be a few thousandths of an inch. FIG. 20 discloses a support 2000 that has a substantially uniform diameter 2001 as opposed to the tapered support 1904 of FIG. 19.

Figure 21:
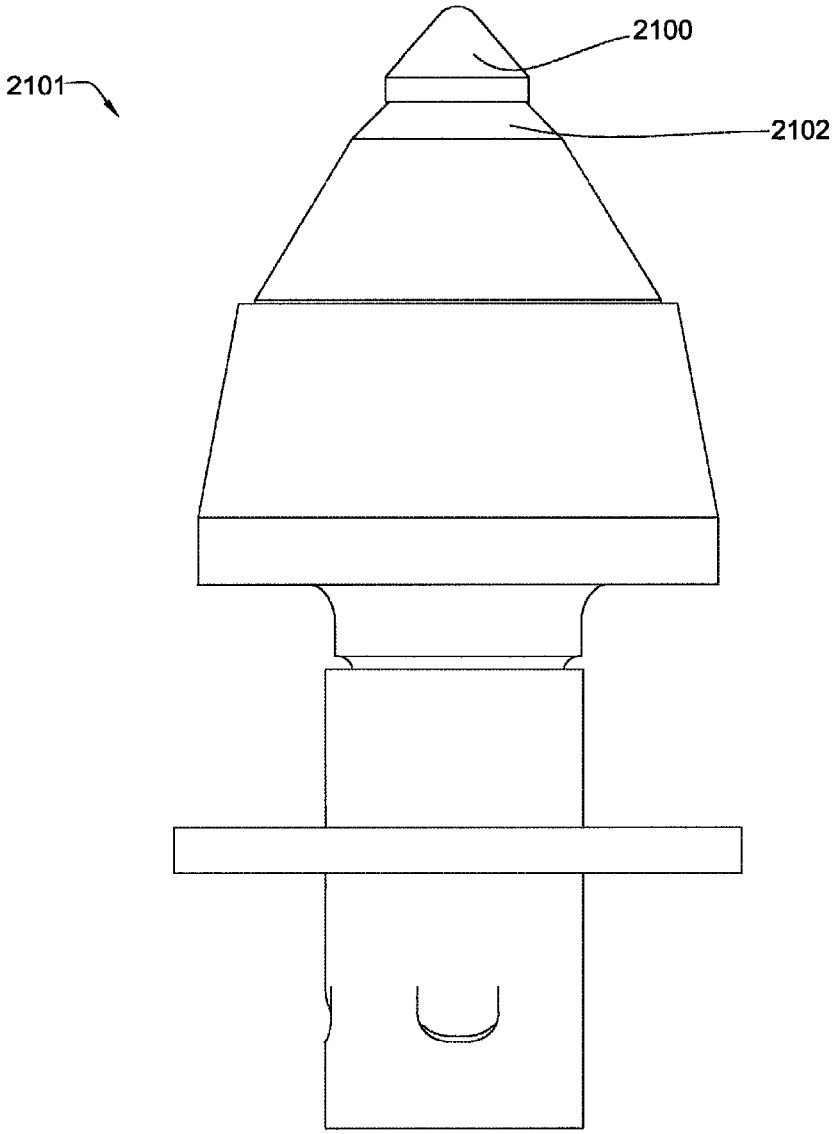
FIG. 21 is an orthogonal view of an embodiment of a road milling pick.

FIG. 21 discloses a high impact tool 2100 attached to an asphalt degradation pick assembly 2101. High impact tool 2100 may be brazed or otherwise attached to a carbide bolster 2102, and the assembly 2101 may be mounted to an asphalt degradation drum or to a mining device.

Figure 22:
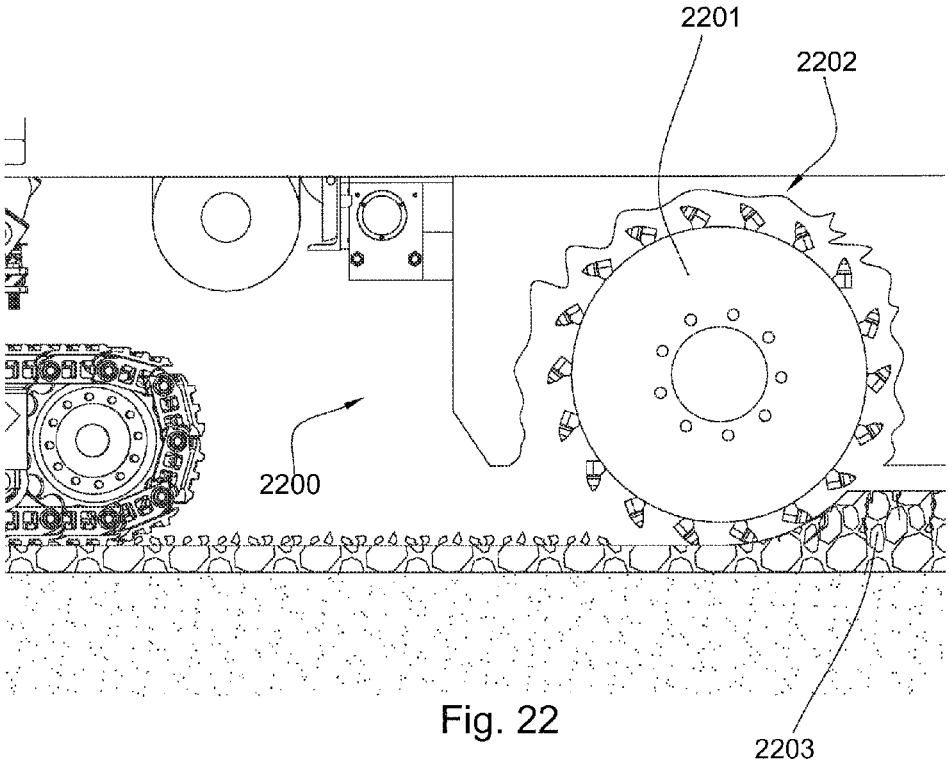
FIG. 22 is an orthogonal view of an embodiment of a pavement degradation machine.

FIG. 22 shows an asphalt degradation machine 2200 comprising an asphalt milling drum 2201. A plurality of high impact tools 2202 are attached to milling drum 2201. The milling drum rotates as the machine advances along a formation 2203, causing the high impact tools to impinge and degrade the formation.

Figure 23:
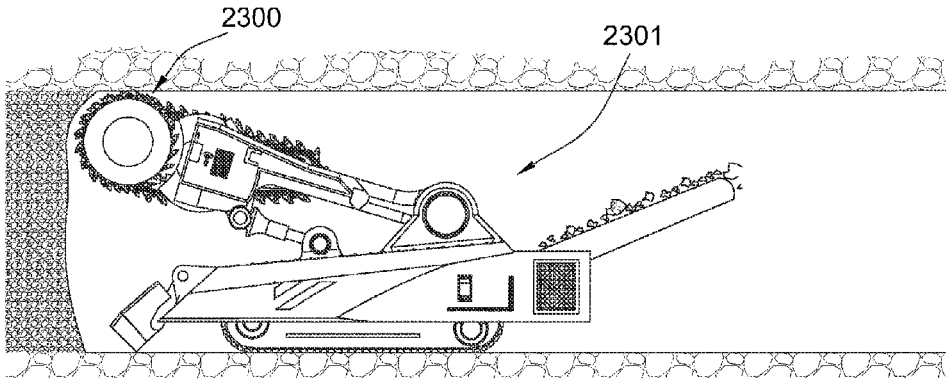
FIG. 23 is an orthogonal view of an embodiment of a mining machine.

FIG. 23 discloses high impact tools 2300 incorporated into a mining machine 2301.

Figure 24:
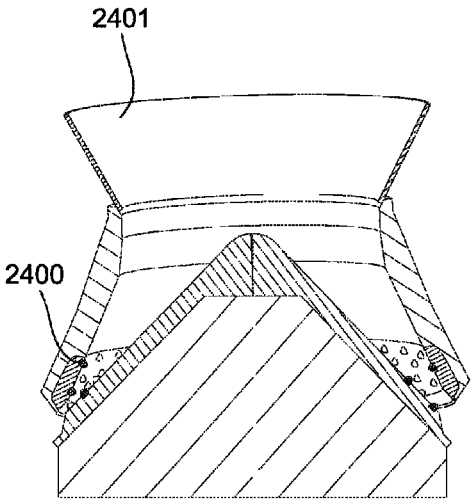
FIG. 24 is an orthogonal view of an embodiment of a cone crusher.

FIG. 24 discloses high impact tools 2400 incorporated into a cone crusher 2401.

Figure 25:
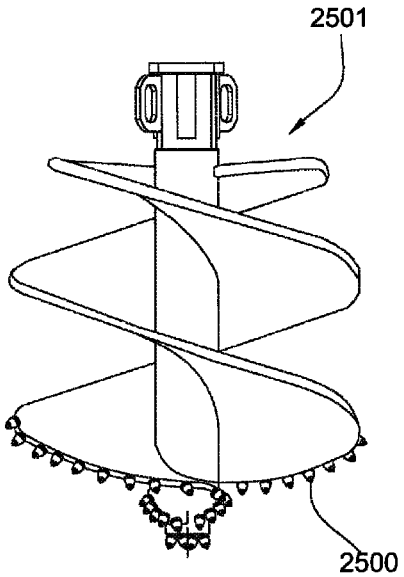
FIG. 25 is an orthogonal view of an embodiment of an auger drilling machine.

FIG. 25 discloses high impact tools 2500 incorporated into a auger drilling assembly 2501.

Figure 26:
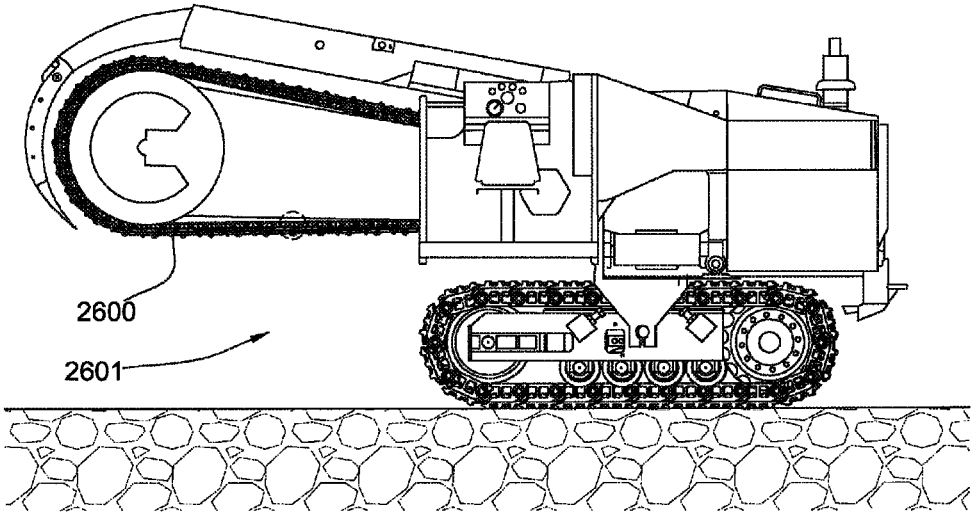
FIG. 26 is an orthogonal view of an embodiment of a trencher.

FIG. 26 discloses high impact tools 2600 incorporated into a mining machine 2601.

Figure 27:
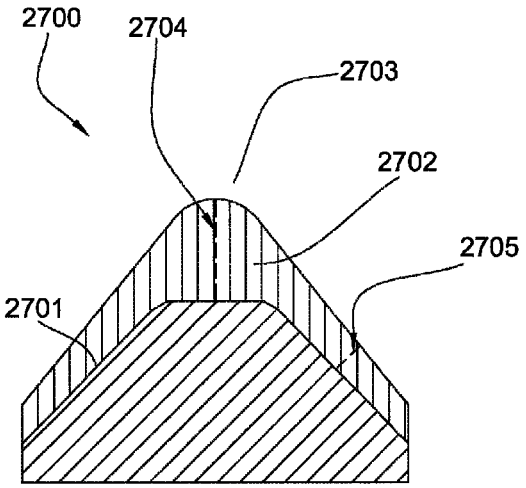
FIG. 27 is a cross-sectional view of another embodiment of a high impact tool.
Figure 28:
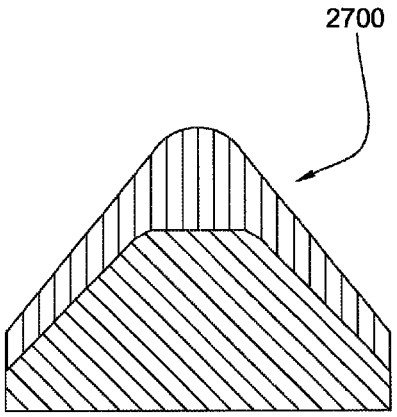
FIG. 28 is a cross-sectional view of another embodiment of a high impact tool.
Figure 29:
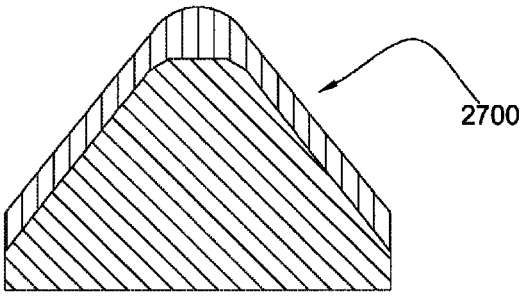
FIG. 29 is a cross-sectional view of another embodiment of a high impact tool.

FIGS. 27-29 disclose high impact tools 2700 with the substrate's taper 2701 covered by a sintered polycrystalline diamond body 2702. The body's thickness along the taper is substantially uniform. However, the body's thickness proximate the body's apex 2703 is greater than along the taper. In some embodiments, the body's apex thickness 2704 is at least twice the taper thickness 2705. In other embodiments, the difference is only a 50% increase. Preferably, the body's apex thickness is sufficient to buttress the diamond when impacts are loaded at the apex.

Whereas the present invention has been described in particular relation to the drawings attached hereto, it should be understood that other and further modifications apart from those shown or suggested herein, may be made within the scope and spirit of the present invention.

What is claimed is:

1. A high impact resistant tool, comprising:

a sintered diamond body bonded to a substrate at an interface;

the diamond body comprising a substantially pointed geometry with an apex;

the apex comprising a curved surface that tangentially joins a leading side and a trailing side of the diamond body at a first and second transitions respectively; and where the leading side and the trailing side form different angles with respect to an axis normal to a surface of the substrate and passing through the apex;

wherein the apex comprises a curved surface with a radius of curvature ranging from 0.05 to 0.11 inches.

2. The tool of claim 1, wherein the apex comprises a curved surface having a variable radius of curvature.

3. The tool of claim 1, wherein the apex comprises a linear surface.

4. A high impact resistant tool, comprising:

a sintered diamond body bonded to a substrate at an interface and a central axis extending longitudinally therethrough;

the sintered diamond body comprising a substantially pointed geometry with an apex, an apex axis extending from the substrate and transversely through the apex; and where the apex axis is offset from the central axis;

wherein the apex comprises a curved surface with a radius of curvature ranging from 0.05 to 0.11 inches.

5. The tool of claim 4, wherein the apex comprises a curved surface having a variable radius of curvature.

6. The tool of claim 4, wherein the apex comprises a linear surface.

7. The tool of claim 4, wherein the interface is non-planar.

8. A high impact resistant tool, comprising:

a sintered diamond body bonded to a substrate at an interface and a central axis extending longitudinally therethrough;

the sintered diamond body comprising a substantially pointed geometry with an apex, an apex axis extending from the substrate and transversely through the apex; and where the apex axis is offset from the central axis, wherein the apex comprises a linear surface, and wherein the apex comprises a curved surface with a radius of curvature ranging from 0.05 to 0.11 inches.

9. The tool of claim 8, wherein the interface is non-planar.

* * * * *